United States Patent [19]

Main

[11] 4,343,973

[45] Aug. 10, 1982

[54] LOW COST ELECTRICAL SWITCH

[75] Inventor: Robert T. Main, Arlington Heights, Ill.

[73] Assignee: Cherry Electrical Products Corp., Waukegan, Ill.

[21] Appl. No.: 177,786

[22] Filed: Aug. 13, 1980

[51] Int. Cl.[3] ..... H01H 13/70

[52] U.S. Cl. ..... 200/159 B; 200/5 A

[58] Field of Search ..... 200/159 B, 5 A, 275, 200/283

[56] References Cited

U.S. PATENT DOCUMENTS

| | | | |
|---|---|---|---|
| 2,262,777 | 11/1941 | Roper . | |
| 2,343,060 | 2/1944 | Horning . | |
| 2,381,835 | 8/1945 | Moorhead . | |
| 2,391,238 | 12/1945 | Horman . | |
| 3,290,439 | 12/1966 | Willcox et al. . | |
| 3,673,357 | 6/1972 | Molchan | 200/5 A |
| 3,725,907 | 4/1973 | Boulanger | 200/5 E |
| 3,749,859 | 7/1973 | Webb et al. | 200/159 B |
| 3,971,902 | 7/1976 | Wulf et al. | 200/5 A |
| 4,034,176 | 7/1977 | Larson | 200/159 B |
| 4,045,636 | 8/1977 | Yoder et al. | 200/159 B |
| 4,086,451 | 4/1978 | Boulanger | 200/159 B |
| 4,128,744 | 12/1978 | Seeger | 200/159 B |

OTHER PUBLICATIONS

"Flex Key", Integrated Decimal Keyboard Units, Data Bulletin DK-1, Flex Key Corp., 1970.

*Primary Examiner*—Stephen Marcus

*Attorney, Agent, or Firm*—Hume, Clement, Brinks, Willian & Olds, Ltd.

[57] ABSTRACT

An improved low cost electrical switch has a two-piece housing comprising a base and an escutcheon. The escutcheon includes a frame and a face plate which is flexible, resilient and insulative. Application of downward finger pressure on the face plate causes the face plate to deform, thereby urging a snap action dome into a shorting position across a pair of electrical contacts.

10 Claims, 3 Drawing Figures

LOW COST ELECTRICAL SWITCH

BACKGROUND OF THE INVENTION

This invention generally relates to improvements in electrical switches, and in particular relates to switches which have a minimal number of parts, are small in size, can be manufactured at a reduced cost, and yet remain rugged, reliable and contaminant resistant. The invention further relates to switches of the type described which are capable of providing the operator with tactile feedback, i.e. sensory information that the switch has been actuated from an open circuit position to a closed circuit position, and vice versa.

There have been many attempts to develop inexpensive, yet reliable electrical switches which have these capabilities, some of which have met with substantial success. Nonetheless, because of increasing pressures to reduce costs, the need still exists for an improved, low cost electrical switch. The switch disclosed herein was developed to satisfy that need.

In summary, the improved electrical switch herein disclosed comprises a two-piece housing having a base and an escutcheon. The escutcheon preferably includes an integrally formed face plate comprising a flexible, resilient, insulative membrane. A first electrical contact is secured to the base in alignment with the face plate, and a second electrical contact is also secured to the base, preferably offset from the first contact. Electrically conductive means, such as a snap action dome, has a center portion normally disposed above the first contact, and a peripheral portion electrically connected to said second contact. The face plate is adapted to move a sufficient distance in response to applied pressure to force the center portion of the dome into contact with the first electrical contact, thereby providing a temporary electrical connection between the first and second contacts. The face plate is further adapted to return to its original position upon release of the pressure so applied, thereby breaking said temporary electrical connection.

BRIEF DESCRIPTION OF THE DRAWINGS

A preferred embodiment of the invention summarized above is shown in the accompanying drawings in which.

DETAILED DESCRIPTION OF EXEMPLARY EMBODIMENT

Figure 1:
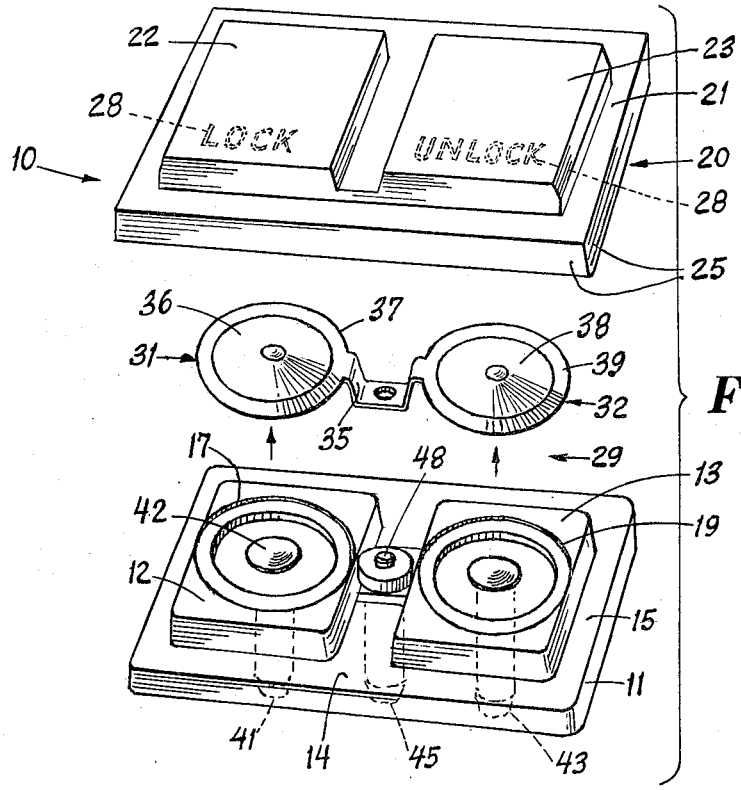
FIG. 1 is a simplified, exploded perspective view of an exemplary embodiment of the invention.
Figure 2:
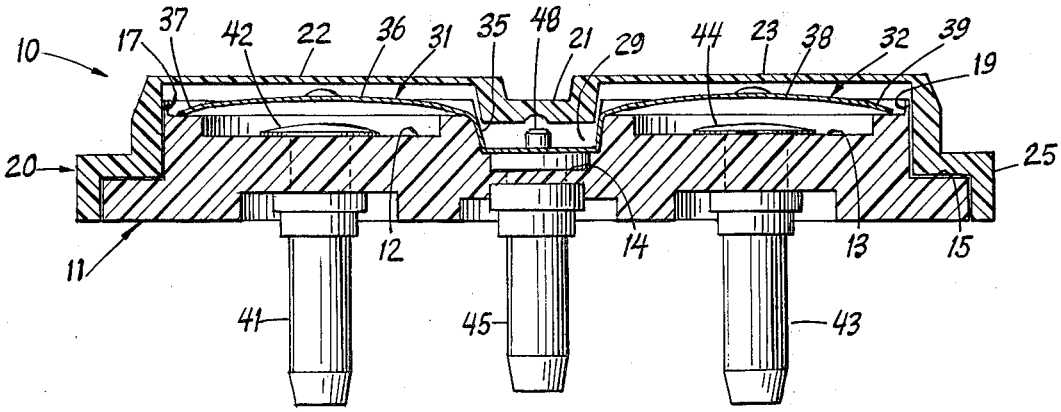
FIG. 2 is a schematic view of the exemplary embodiment shown in FIG. 1.
Figure 3:
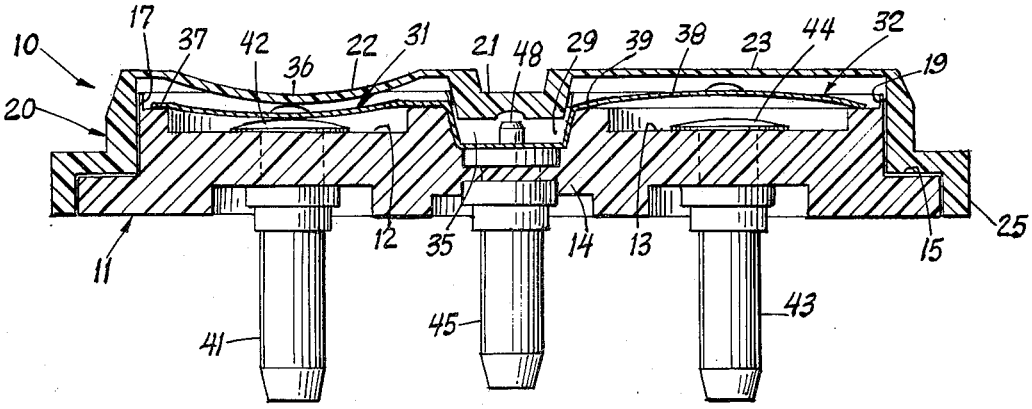
FIG. 3 is another schematic view of the exemplary embodiment shown in FIG. 1.

Referring now to FIGS. 1–3, there is shown an electrical switch 10 having a two-piece housing comprising a base 11 and an escutcheon 20. Base 11 and escutcheon 20 are preferably secured together by ultrasonically welding peripheral portions 25 of escutcheon 20 with marginal portions 15 of base 11 to provide a sealed interior chamber 29.

Escutcheon 20 has a frame portion 21 defining a pair of surface protuberances preferably in the form of integral face plates 22, 23. Base 11 also has a pair of surface protuberances in the form of support surfaces 12, 13. As shown in the figures, support surfaces 12, 13 are aligned below respective face plates 22, 23.

Base 11 and escutcheon 20 are preferably fabricated from an insulative material such as a suitable polycarbonate. On such polycarbonate is Lexan sold by the General Electric Co. of Schenectady, N.Y. In this exemplary embodiment, the thickness of both the base 11 and the escutcheon 20, with the exception of face plates 22, 23, is approximately 0.040". The thickness of face plates 22, 23 is approximately ¼ of the thickness of escutcheon 20—in this exemplary embodiment such thickness being approximately 0.011". It has been found that this thickness of the face plate 22, 23 gives them a flexible, resilient quality which permits them to actuate the switch 10 without puncture, all as explained in greater detail hereinafter. Thus, actuation of switch 10 can be achieved without mechanical keys, insulative spacers, and/or separate conductive laminate sheets, as are often required in prior art devices.

Still referring to FIGS. 1–3, there is shown a pair of electrical conductive means 31, 32 interconnected by an electrical conductor 35. Electrical conductive means 31, 32 and electrical conductor 35 are preferably integrally formed by stamping them from a sheet of electrically conductive material such as copper, brass or a suitable alloy all in a manner well known to those skilled in the art. Electrically conductive means 31, 32 are preferably stamped in the shape of a convex disc or dome, having center portions 36, 38 elevated above peripheral portions 37, 39. As is well known in the art, this provides an over center snap action effect when downward pressure is applied to center portions 36, 38. These snap action domes identified herein as electrically conductive means 31, 32 are monostable, however, and therefore spring back to their original positions when such downward pressure is removed.

The electrically conductive means 31, 32 are located at respective support surfaces 12, 13, of base 11 preferably with center portions 36, 38 raised above said surfaces, and peripheral portions 37, 39 seated on said surfaces and captivated therein by respective rims 17, 19. Also located at support surfaces 12, 13 are a pair of corresponding electrical contacts 41, 43. In particular contact 41 has a terminus 42 at support surface 12 which is normally spaced a predetermined distance below center portion 36 of electrically conductive means 31. Similarly contact 43 has a terminus 44 at support surface 13 which is normally spaced a predetermined distance below center portion 38 of electrically conductive means 32.

Base 11 further includes a common surface 14 for supporting electrical conductor 35 which interconnects electrically conductive means 31, 32. A third contact 45 has means 48 for securing conductor 35 and contact 45 in place at common surface 14. As shown in the Figures in this exemplary embodiment, each of the three contacts 41, 43, 45 extend below base 11 and is readily adapted for interconnection with a suitable plug or jack, not shown.

The operation of switch 10 can be best explained by reference to FIG. 3. In particular, because of the relatively thin cross-sectional dimension of face plate 22, the application of a downward force thereto, such as operator finger pressure, causes face plate 22 to deform without puncturing. This deformation of face plate 22 forces center portion 36 of electrically conductive means 31 to move downwardly until it engages terminus 42 of contact 41. When so engaged, electrically conductive means 31 effectively shorts contacts 41 and 45.

The operator applying a downward finger force on face plate 22 can sense the over center movement of center portion 36 of electrically conductive means 31. This sensation is commonly referred to as tactile feedback. When the finger force is removed, however, center portion 36 and face plate 22 return to their normal positions as shown in FIG. 2. Of course, electrically conductive means 32 will achieve the same result if a downward force is applied to face plate 23.

Those skilled in the art will recognize that switch 10 has countless uses and applications. One such application is a "lock" and "unlock" switch for the doors of an automobile. In particular, if a solenoid and a source of electromotive force (not shown) are appropriately connected between the lower ends of contacts 41 and 45, depression of face plate 22 can energize the solenoid and automatically lock the vehicle doors in a manner well known in the art. Similarly, if a solenoid and a source of electromotive force (not shown) are appropriately connected between the lower ends of contacts 43 and 45, depression of face plate 23 can energize the solenoid causing the vehicle doors to automatically unlock. A suitable graphic 28 can be applied to the surfaces of face plates 22, 23 to inform the operator of the specific purpose of switch 10.

What has been described is an improved low cost electrical switch. The switch has a minimal number of parts, thereby eliminating the need for mechanical keys, insulative spacers and conductive laminate sheets. This is accomplished, in part, by the thinned face plate portions integrally formed in the escutcheon. Of course, many modifications and variations which do not depart from the true scope of the invention will be readily apparent to those skilled in the art. Accordingly, all such modifications and variations are intended to be covered by the appended claims.

I claim:

1. An electrical switch comprising:

at least one electrically conductive contact means having an extending conductive strip with an aperture formed therethrough;

a base having a top surface and a bottom surface;

at least one electrically conductive switching terminal extending through the base and having an electrically conductive head portion exposed on said top surface;

at least one electrically conductive common terminal extending through the base and having an upstanding electrically conductive post extending above a portion of said top surface;

means for supporting a contact portion of said at least one electrically conductive contact means in spaced relation over at least one switching terminal with the upstanding electrically conductive post passing through the aperture of said extending conductive strip and the strip contacting the head of the common terminal; and an insulative cover extending over the top surface of the base, the cover including at least one flexible, resilient face plate portion for flexing downwardly relative to the base in response to applied pressure and pressing the contact portion of said at least one electrically conductive contact means against at least one underlying switching terminal, the face plate and the contact portion of the conductive contact means returning to respective unflexed positions when the pressure is removed.

2. The electrical switch of claim 1, wherein said contact portion of said at least one electrically conductive contact means is a snap action dome.

3. The electrical switch of claim 1, wherein said cover includes a frame portion integral with said at least one face plate portion for supporting the face plate portion, said frame portion having a thickness substantially equal to four times the thickness of the face plate portion.

4. The electrical switch of claim 1, wherein said at least one face plate portion has a graphic thereon.

5. An electrical switch comprising:

a plurality of electrically conductive contact means;

conductive connecting means for interconnecting said plurality of conductive contact means, said conductive connecting means having at least one aperture formed therethrough;

a base having a top surface and a bottom surface;

a plurality of electrically conductive switching terminals extending through the base, each terminal having a conducting head portion exposed on said top surface;

at least one electrically conductive common terminal extending through the base and having an upstanding electrically conductive post extending above a portion of said top surface;

means for supporting each of said electrically conductive contact means in spaced relation over at least one associated switching terminal, with at least a portion of the conductive connecting means conductively contacting the common terminal and the upstanding post extending through said aperture; and an insulative cover extending over the top surface of the base, the cover including a plurality of flexible, resilient face plate portions, each face plate portion overlying a conductive means for flexing downwardly relative to the base in response to applied pressure and pressing the underlying conductive contact means against its associated switching terminal, the flexed face plate and conductive contact means returning to respective unflexed positions when the pressure is removed.

6. The electrical switch of claim 5, wherein the top surface of said base includes a plurality of switch indentations with floors defined at a first depth in the base and at least one common indentation with a floor defined at a second greater depth in the base, the floor of each switch indentation supporting the head portion of a switching terminal and the floor of said common indentation supporting at least a portion of said conductive connecting means.

7. The electrical switch of claim 5, wherein each electrically conductive contact means is a snap action dome.

8. The electrical switch of claim 5, wherein said cover includes a frame portion integral with said face plate portions for supporting the face plate portions, said frame portion having a thickness at least four times the thickness of a face plate portion.

9. The electrical switch of claim 5, wherein each of said face plate portions has a graphic thereon.

10. An electrical switch, comprising:

two snap action dome conducting contacts interconnected by a conducting strip having an aperture formed therethrough;

a base having a top surface and a bottom surface, the base including two spaced switching terminals and a third common terminal positioned in spaced relation between the switching terminals;

each terminal extending through the base and including a conducting head portion exposed on said top surface;

the base having means for supporting said snap action dome contacts so that one of the contacts is suspended over and in spaced relation to the head portion of one of the switching terminals and the other of the contacts is suspended over and in spaced relation to the head portion of the other of the switching terminals;

said third common terminal having an upstanding conducting post at its head portion for passing through said aperture to allow the third common terminal to conductively contact said conducting strip; and a cover for covering and sealing the top surface of the base, the cover having resilient insulating face plate areas, each resilient face plate area overlying an associated snap action dome contact and dimensioned for flexing downwardly relative to the base in response to applied pressure to flex its underlying contact against an underlying head portion of a switching terminal, the downwardly flexed snap action dome contact and face plate area returning to their respective unflexed positions when the applied pressure is released.

* * * * *

UNITED STATES PATENT AND TRADEMARK OFFICE

CERTIFICATE OF CORRECTION

PATENT NO. : 4,343,973

DATED : August 10, 1982

INVENTOR(S) : Robert T. Main

It is certified that error appears in the above—identified patent and that said Letters Patent is hereby corrected as shown below:

column 1, line 13, after "i.e.", insert --,--.

At column 2, line 3, delete "plate" and insert --plates--.

At column 2, line 57, delete "extend" and insert --extends--.

At column 4, line 39, after "conductive", insert --contact--.

Signed and Sealed this

*Fourteenth* Day of *June 1983*

[SEAL]

*Attest:*

DONALD J. QUIGG

*Attesting Officer*

*Acting Commissioner of Patents and Trademarks*